United States Patent [19]

Brien

[11] Patent Number: 5,001,687

[45] Date of Patent: Mar. 19, 1991

[54] WRISTWATCH WITH A SWITCHING CROWN

[76] Inventor: André Brien, 1390 Boul. De la Concorde W., Apt. 408, Laval, Quebec, Canada, H7N 5P5

[21] Appl. No.: 460,249

[22] Filed: Jan. 2, 1990

[51] Int. Cl.[5] ..... G04B 29/00

[52] U.S. Cl. ..... 368/321; 368/320

[58] Field of Search ..... 368/319–321, 368/306

[56] References Cited

U.S. PATENT DOCUMENTS

| | | | |
|---|---|---|---|
| 2,245,302 | 6/1941 | Schmitz | 368/319 |
| 3,975,896 | 8/1976 | Kasama | 368/319 |
| 4,268,913 | 3/1981 | Nakagiri et al. | 368/320 |
| 4,400,095 | 8/1983 | Namyslo | 368/319 |
| 4,423,966 | 1/1984 | Ogihara et al. | 368/320 |
| 4,435,796 | 3/1984 | Saito et al. | 368/320 |
| 4,727,526 | 2/1988 | Tajama et al. | 368/319 |

FOREIGN PATENT DOCUMENTS

| | | | |
|---|---|---|---|
| 212475 | 11/1940 | Switzerland | 368/320 |

*Primary Examiner*—Bernard Roskoski

[57] ABSTRACT

A wristwatch having a switching crown to effectuate an electrical switch function. The switching crown comprises a crown element constructed from electrically conductive material. The crown is in contact with a first conductor element connected to one side of a battery. A second conductor element extends in a portion of the crown and electrically isolated therefrom. A peripheral inner end portion of the crown is disposed closely spaced to the second conductor element. The peripheral inner end portion is placed in contact with the second conductor element by maintaining a side pressure on the crown element to effectuate a switch closure.

12 Claims, 3 Drawing Sheets

WRISTWATCH WITH A SWITCHING CROWN

BACKGROUND OF INVENTION

1. Field of Invention

The present invention related to a wristwatch having a switching crown to effectuate an electrical switch function by applying side pressure to the crown element so as to operate an electrically operable element, such as a lamp or any other switchable electrical element provided in a wristwatch.

2. Description of Prior Art

It is known to provide lamps or other electrical elements in a wristwatch and most of these are actuated by placing an independent switch button on the casing of the wristwatch. Also, with the prior art, electrical wiring , switches and connections need to be disposed within the wristwatch in order to connect the various electrical elements to a battery which is located in the wristwatch housing to provide electrical current to operate these elements. Also, with the prior art wristwatch incorporating electrical elements, such as miniature lamp bulbs, it is difficult to assemble the wristwatch and/or the wiring to these electrical elements and it is also difficult to repair the lamp bulbs.

SUMMARY OF INVENTION

It is a feature of the present invention to provide a wristwatch having a switching crown capable of effectuating an electrical switch function by applying side pressure to the crown and which substantially overcomes many of the above-mentioned disadvantages of the prior art.

According to the above feature, from a broad aspect, the present invention provides a wristwatch having a switching crown to effectuate an electrical switch function The switching crown comprises a crown element constructed from electrically conducted material. The crown is in contact with a first conductor element connected to one side of a battery. A second conductor element extends in a portion of the crown and electrically isolated therefrom. Contacting means is provided in contact with the crown and disposed in close proximity to the second conductor element. The contacting means is placed in contact with the second conductor element by maintaining a side pressure on the crown element to effectuate a switch closure.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1:
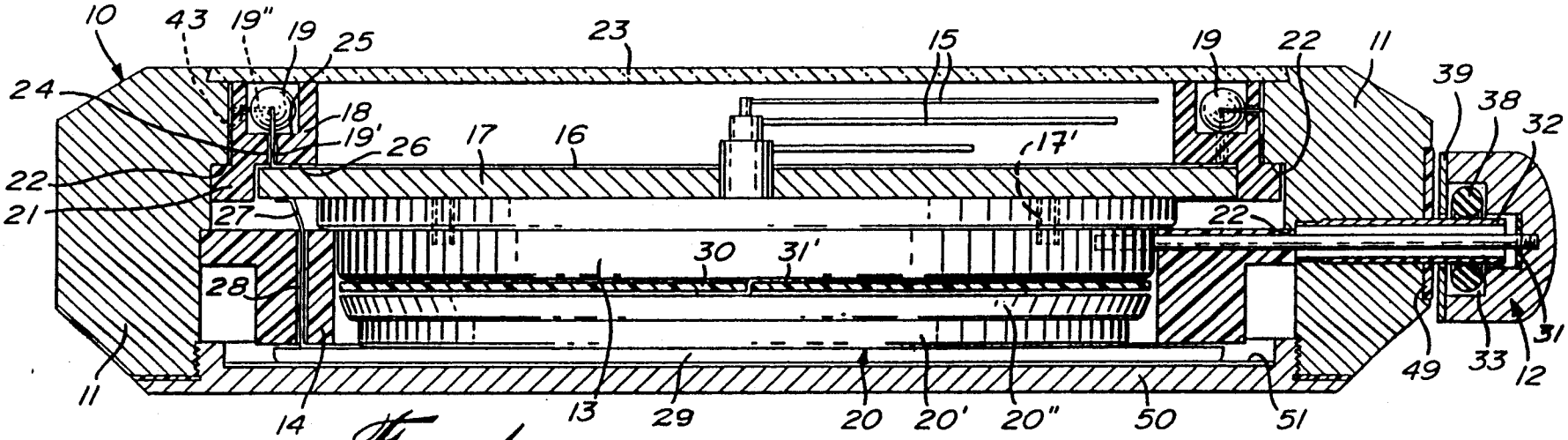
FIG. 1 is an enlarged section view of a wristwatch incorporating the switching crown of the present invention.
Figure 1A:
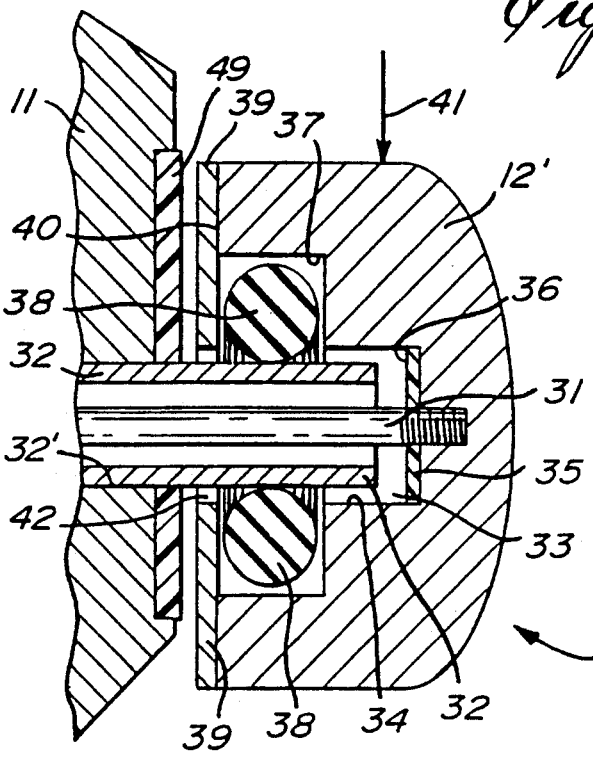
FIG. 1A is an enlarged view of the switching crown assembly.

Referring now to the drawings, and more particularly to FIG. 1 and 1A, there is shown at 10, a wristwatch incorporating the switching crown 12 of the present invention. As herein shown, the wristwatch 10 has a casing 11 which supports therein a watch movement 13. The watch movement 13 is insulated from the casing 11 by an insulating support ring 14. The watch movement 13 is connected to the time indicators 15, supported elevated above the top surface 16 of the dial face disc 17.

A lamp support ring 18 is disposed about the dial face disc 17 and is provided with one or more miniature lamps 19 therein. The lamp support ring 18 is constructed of electrically insulating and light transmitting material such as plastics which may be clear or colored whereby when the lamps 19 conduct the ring acts as a light conductor to illuminate all or at least a portion of the dial top surface 16. The ring 18 isolates the dial disc 17 from the casing 11. Power is supplied to these lamps 19 by a waffer cell battery 20 which is connected thereto, in a manner which will be described herein below, and through the switching crown 12. It is also pointed out that the dial disc 17 is insulated from its own movement 13 by insulated support legs 17'. Thus, the disc 17 is only in electrical contact with the flexible spring battery contact 27.

The lamp support ring 18 is provided with a retention flange 21 circumferentially about the ring or in segments thereabout to become captive between an undercut portion 22 of the casing 11 and the top face 16 of the dial disc 17 whereby to permit for the removal of the transparent cover 23 with the lamp support ring 18 and the disc 17 retained in position. Accordingly, the ring cannot dislodge itself when the transparent cover 23 is removed. To replace a lamp 19, all that is necessary to do is to remove the lamp support ring 18 and simply retract the defective lamp which is not welded to any conductor. A new lamp is positioned with its terminal end wires 19' and 19'' placed in their respective locating holes 19 and 43 and bent on the outside surfaces of the lamp support ring 18 for frictional engagement with the dial disc 17 and the casing 11, respectively.

One terminal end wire, namely wire 19' of the lamp 19 is connected to the negative side 20' of the waffer cell 20 through the dial disc 17 which is constructed of metal. This base of the lamp support ring cavity 25 and is bent under the lamp support ring lower surface 26 to be placed in frictional electrically contact with the top face 16 of the dial disc 17. A contact spring 27 extends through a cavity 28 provided in the insulating support ring 14 to engage with a metal disc 29 placed over the waffer cell 20 and in engagement with the negative side 20' of the waffer cell. The disc 29 is insulated from the rear cover 50 by a plastic disc 51. Accordingly, the lamp terminal 19' is connected to the negative side of the cell 20. The disc 29 can also be replaced by a spring contact (not shown) interconnecting the contact 27 to the cell negative side 20'.

The positive side 20'' of the cell 20 has an electrically insulating disc 30 provided thereover and an electrical connection is made with the watch movement 13 through a spring contact 31. Accordingly, the watch movement 13 has a positive charge applied thereto. This watch movement 13 is in contact with the metal stem 31 which is utilized to effectuate adjust functions in the watch movement, such as the displacement of the arms 15 or calendar mechanism and is operated by rotation or axial displacement of the crown head 12'. This stem 31 is a common element in wristwatch construction. As shown in FIG. 1A, the end of the stem 31 is connected to the crown head 12' and accordingly, the crown head 12' is connected to the positive side of the cell 20. The stem 31 constitutes a first conductor element of the switching crown. A second conductor element in the form of a stationary metal tube 32, held in a bore 32' made in the casing 11, is electrically insulated in its extended portion within the crown and disposed concentrically about the portion of the stem 31 which extends into the connecting cavity 33 of the crown head 12' and also extends in spaced relationship to the inner surface or inner wall 34 of the connecting cavity 33. An insulating disc 35 may be positioned about the end wall 36 of the cavity 33 but this is usually not necessary as the metal tube 32 is spaced from this end wall.

A ring cavity 37 is also formed about the open end of the connecting cavity 33 and receives therein an O-ring seal 38 of compressible non-conductive material This O-ring seal is herein shown as having a circular cross-section and is in contact about the metal tube 32 to maintain the tube spaced from the inner wall 34. A retainer ring 39, of conductive material, is secured to the peripheral inner end 40 of the crown about the ring cavity 37 and provides a switch contacting means to engage the metal tube 32 when side pressure is applied to the crown head 12 in the direction of arrow 41. This side pressure 41 closes the gap 42 between a portion of the retainer ring 39 in the metal tube 32 and constitutes a switch contact. By closing a portion of this gap the metal tube 32 becomes connected to the positive side of the battery 20. Because the metal tube 32 is connected to the casing 11, the casing then assumes the positive charge. By maintaining side pressure on the crown a closed switch function is maintained.

As can be seen from FIG. 1, the other terminal end 19'' of the lamp 19 extends through a locating hole 43 provided on the outside wall of the lamp support ring 18 and is bent over that side wall for frictional engagement with the casing 11. Accordingly, the lamp terminals 19' and 19'' are connected across the cell 20 whenever lateral pressure is applied to the crown head 12'. Thus, a current flows through the lamp which illuminates the support ring to light the top face 16 of the dial disc 17.

Figure 2:
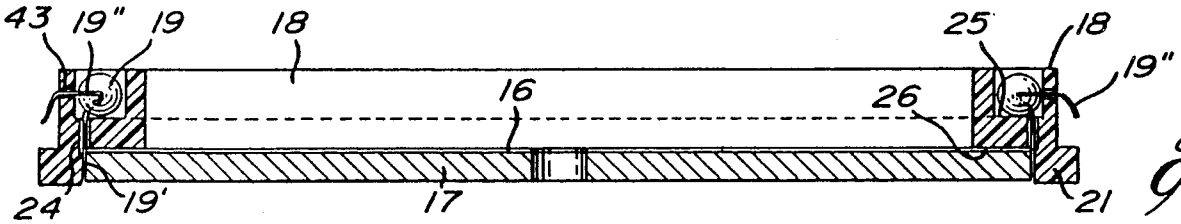
FIG. 2 is a transverse section view illustrating the construction of the insulating lamp support ring.
Figure 3:
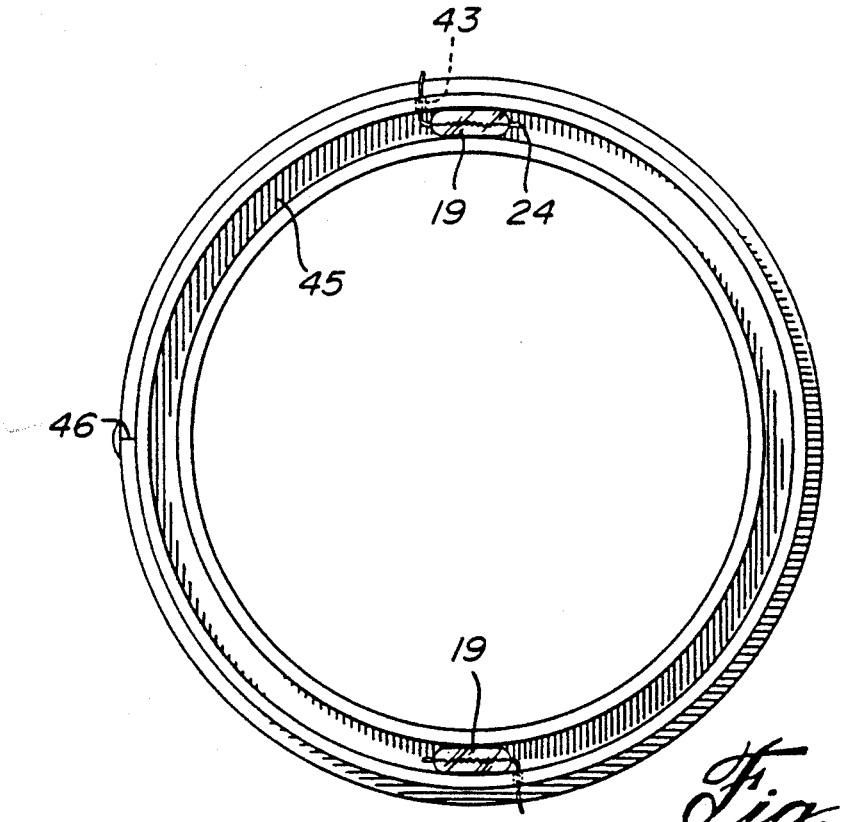
FIG. 3 is a top view of the support ring of FIG. 2.

Referring now to FIG. 3, there is shown the lamp support ring 18 of FIG. 2. As can be seen, this ring may have a circumferential channel 45 which permits a plurality of lamps 19 to be disposed therealong. The holes 24 and 43 formed within that channel dictate the position of the lamps 19. An indicator mark 46 may also be provided on the ring to assist in the assembly of the ring within the watch casing so that the ring and the lamps 19 are always located at predetermined positions about the dial face.

Figure 4:
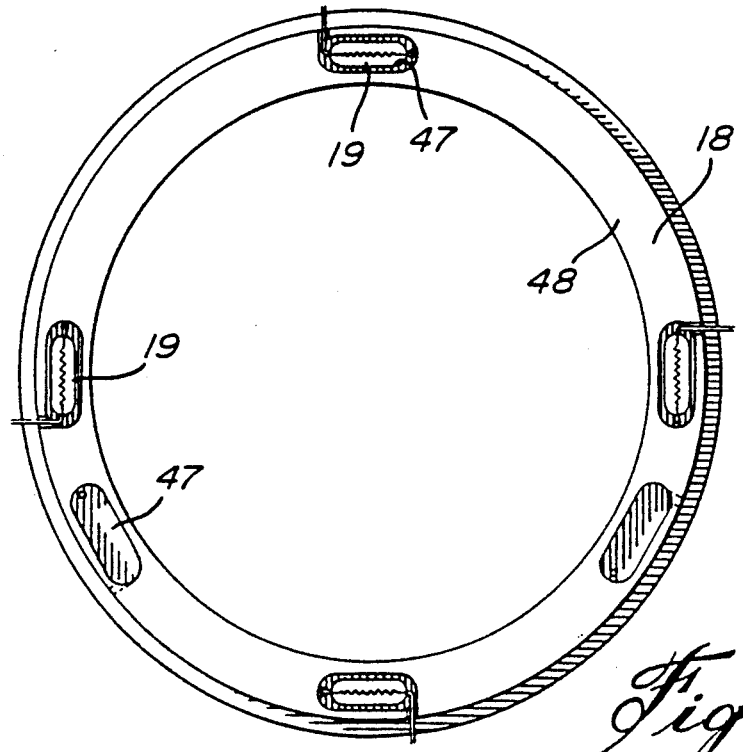
FIG. 4 is a top view of another insulating lamp support ring illustrating a modification thereof.

FIG. 4 shows a different construction of this support ring 18 and as herein shown, cavities 47 are formed in a top wall 48 of the ring and again to precisely locate the lamps 19 therealong.

Figure 5:
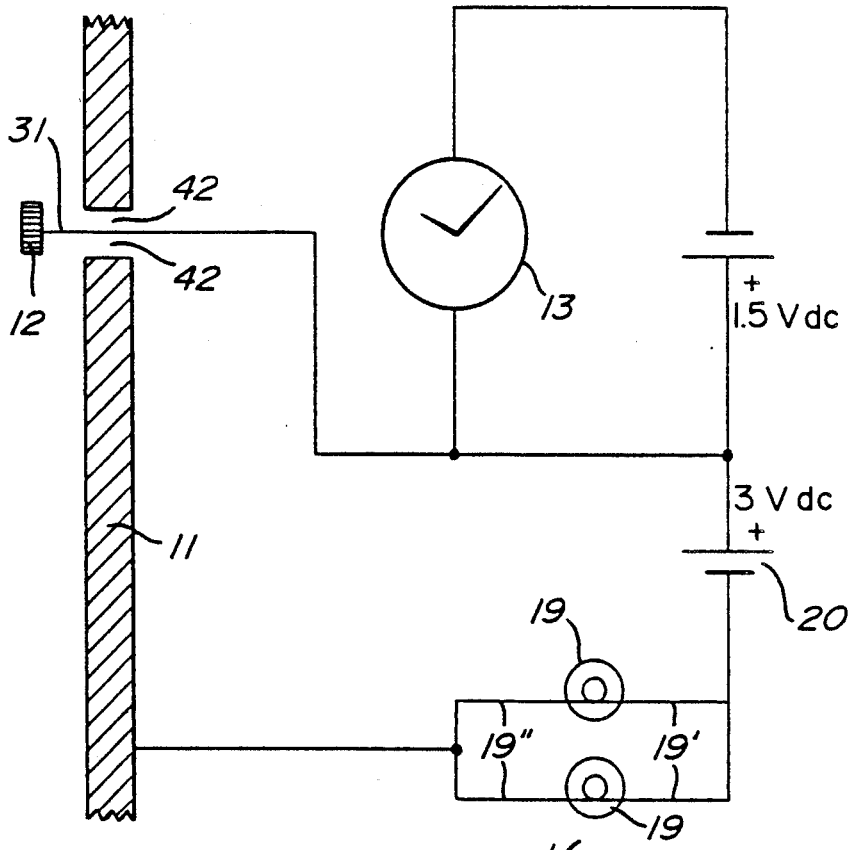
FIG. 5 is an electrical diagram illustrating the switching circuit the present invention incorporating the switching crown in a wristwatch construction.

FIG. 5 is a simplified view showing the electrical circuit of the present invention.

The assembly of the wristwatch 10 incorporating the switching circuit and crown of the present invention is extremely simplified by using the casing and watch dial as conductive circuit elements. By removing the rear cover 50 access is provided to the entire watch subassemblies including the lamp support ring 18. When assembling the wristwatch, the lamp support ring 18 is placed in position over the undercut 22 of the casing 11 and the entire movement 13 is then disposed thereover, as shown in FIG. 1. The insulating support ring 14 can then be positioned about the movement and the insulating disc 30 and its electrical contact 31 disposed behind the movement. The waffer cell 20 is then placed over the insulating disc 30 and the metal disc 29 over the negative end 20' of the cell 20. The rear cover 50 is then threaded into engagement. The switching crown assembly 12 is then positioned over the metal tube 32 with the stem 31 threaded in engagement within the watch movement, in a manner well known in the art. It is also pointed out that an insulating disc 49 is also disposed about the metal tube 32 and adjacent the retention ring 39 to insulate the ring from the casing 11.

It is within the ambit of the present invention to cover any obvious modifications of the preferred embodiments described therein, provided such modifications fall within the scope of the appended claims.

I claim:

1. A wristwatch having a switching crown to effectuate an electrical switch function, said switching crown comprising a crown element constructed from electrically conductive material, said crown being in contact with a first conductor element connected to one side of a battery, a second conductor element extends in a portion of said crown and electrically insulated therefrom, and switch contacting means in contact with said crown and disposed in close proximity to said second conductor element, said contacting means being placed in contact with said second conductor element by maintaining a side pressure on said crown element to effectuate a switch closure.

2. A wristwatch switching crown as claimed in claim 1 wherein said first conductor element is a metal stem secured to said crown and axially displaceable by said crown, said stem being in engagement with a watch movement.

3. A wristwatch switching crown as claimed in claim 2 wherein said second conductor element is a stationary metal tube disposed in spaced relation about a portion of said stem and extending into a connecting cavity in said crown and also in spaced relation to said crown.

4. A wristwatch switching crown as claimed in claim 3 wherein switch contacting means is a peripheral inner end portion of said crown disposed closely spaced about said metal tube.

5. A wristwatch switching crown as claimed in claim 4 wherein said peripheral inner end portion is a retainer ring secured to an inner end face of said crown and disposed concentrically about said metal tube.

6. A wristwatch switching crown as claimed in claim 5 wherein an O-ring seal of compressible non-conductive material is disposed in a ring cavity provided in said connecting cavity and in contact about said metal tube to maintain said tube spaced from an inner wall of said connecting cavity, said seal being compressed by said lateral pressure applied to said crown to permit said retainer ring to touch said tube and effectuate said switch closure.

7. A wristwatch switching crown as claimed in claim 4 wherein said metal tube is secured to a casing of said wristwatch, said casing having a contact connection with a terminal end wire of one or more lamps disposed within said wristwatch, said one or more lamps having their other terminal end wire connected to another side of said battery, said casing being electrically insulated from said watch movement.

8. A wristwatch switching crown as claimed in claim 7 wherein said other side of said battery is connected to a dial face disc, said other terminal end wire of said one or more lamps being in contact with said dial face fisc.

9. A wristwatch switching crown as claimed in claim 8 wherein said one or more lamps are supported in a lamp support ring disposed about said dial face disc whereby to illuminate a top face or portion of said dial face disc, said lamp support ring being constructed of electrically insulating light conducting material, said lamp terminal end wires being frictionally retained against said top face of said disc and said watch casing, respectively.

10. A wristwatch switching crown as claimed in claim 9 wherein said lamp support ring is provided with a retention flange portion to interlock between an undercut portion of said casing and said dial face to permit a transparent cover to be removably positioned over said dial face disc with said lamp support ring retained in position.

11. A wristwatch switching crown as claimed in claim 10 wherein said watch movement is electrically insulated from said casing by an insulating support ring, said battery being a waffer cell disposed within said insulating support ring behind said watch movement, said waffer cell having a positive battery terminal in contact with said watch movement and a negative terminal connected to said dial face by a spring contact supported by said support ring.

12. A wristwatch switching crown as claimed in claim 11 wherein an insulating flat disc is disposed between said cell contact element extending through said insulating flat disc to apply a positive charge from said positive terminal to said watch movement, said lateral pressure when applied to said crown element transmitting said positive charge from said stem in contact with said watch movement to said casing and to said lamp terminal in contact therewith to cause said one or more lamps to conduct and produce light.

* * * * *